US010408485B2

(12) United States Patent
Katori et al.

(10) Patent No.: US 10,408,485 B2
(45) Date of Patent: Sep. 10, 2019

(54) INSTALLATION CHECK SYSTEM

(71) Applicant: DAIKIN INDUSTRIES, LTD., Osaka-shi, Osaka (JP)

(72) Inventors: Machiko Katori, Osaka (JP); Shinya Murai, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 8 days.

(21) Appl. No.: 15/559,307

(22) PCT Filed: Feb. 29, 2016

(86) PCT No.: PCT/JP2016/056013
§ 371 (c)(1),
(2) Date: Sep. 18, 2017

(87) PCT Pub. No.: WO2016/158147
PCT Pub. Date: Oct. 6, 2016

(65) Prior Publication Data

US 2018/0142913 A1 May 24, 2018

(30) Foreign Application Priority Data

Mar. 31, 2015 (JP) ..... 2015-071972

(51) Int. Cl.
*F24F 11/49* (2018.01)
*F24F 11/89* (2018.01)
(Continued)

(52) U.S. Cl.
CPC ..... *F24F 11/49* (2018.01); *F24F 11/30* (2018.01); *F24F 11/36* (2018.01); *F24F 11/38* (2018.01); *F24F 11/89* (2018.01)

(58) Field of Classification Search
CPC .. F24F 11/30; F24F 11/36; F24F 11/38; F24F 11/49; F24F 11/50; F24F 11/52;
(Continued)

(56) References Cited

U.S. PATENT DOCUMENTS 9,863,694 B2 * 1/2018 Broadbent ..... H04L 67/125
2015/0338136 A1 * 11/2015 Suzuki ..... F24F 1/32 62/129

FOREIGN PATENT DOCUMENTS

EP 2 351 971 A2 8/2011
EP 2351971 A2 * 8/2011 ..... F24F 11/30
(Continued)

*Primary Examiner* — Filip Zec
*Assistant Examiner* — Chang H. Park
(74) *Attorney, Agent, or Firm* — Birch, Stewart, Kolasch & Birch, LLP

(57) ABSTRACT

This application discloses an installation check system used for checking installation of an air conditioner before a start of a trail run of the air conditioner. The installation check system includes a display portion for displaying work instruction information about the installation, an input means configured to be operated for entering a check result based on the work instruction information, a determination portion configured to determine whether the start of the trail run is allowed based on the check result, and a signal generator which generates a drive signal to execute the trail run. The signal generator generates the drive signal under condition of the determination portion allowing the start of the trail run.

7 Claims, 7 Drawing Sheets

(51) Int. Cl.
*F24F 11/30* (2018.01)
*F24F 11/36* (2018.01)
*F24F 11/38* (2018.01)

(58) Field of Classification Search
CPC ..... F24F 11/523; F24F 11/526; F24F 11/54; F24F 11/56; F24F 11/57; F24F 11/58; F24F 11/59; F24F 11/89; F25D 29/00; F25B 2700/00
See application file for complete search history.

(56) References Cited

FOREIGN PATENT DOCUMENTS

| | | | | |
|---|---|---|---|---|
| EP | 2682685 | A2 | 1/2014 | |
| JP | 2011-141081 | A | 7/2011 | |
| JP | 2014-202451 | A | 10/2014 | |
| JP | 5697710 | B2 * | 4/2015 | ..... F24F 1/32 |

* cited by examiner

INSTALLATION CHECK SYSTEM

TECHNICAL FIELD

The present invention relates to an installation check system used for checking installation before a start of a trail run of an air conditioner.

BACKGROUND ART

Patent Document 1 proposes techniques for presenting work environment instruction about installation of an air conditioner to an operator working for the installation. According to Patent Document 1, a display portion indicating the work environment instruction is situated in a work site so that the operator easily finds the work environment instruction.

The techniques of Patent Document 1 do not always make the operator do confirmation based on the work environment instruction although the techniques of Patent Document 1 may provide the work environment instruction for the operator. For example, when the operator fails to watch the display portion indicating the work environment instruction or when the operator neglects access to the work environment instruction through a QR code (registered trade mark) displayed on the display portion, a trail run of the air conditioner may be executed under wrong installation.

Patent Document

Patent Document 1: JP 2014-202451 A

SUMMARY OF INVENTION

An object of the present invention is to provide an installation check system configured to allow a trail run of an air conditioner after making an operator execute an appropriate check operation for installation of the air conditioner.

An installation check system according to one aspect of the present invention is used for checking installation of an air conditioner before a start of a trail run of the air conditioner. The installation check system includes a display portion configured to display work instruction information about the installation, an input means configured to be operated for entering a check result based on the work instruction information, a determination portion configured to determine whether the start of the trail run is allowed based on the check result, and a signal generator which generates a drive signal to perform the trail run. The signal generator generates the drive signal under condition of the determination portion allowing the start of the trail run.

The aforementioned installation check system may allow the trail run of the air conditioner after making an operator execute the check operation appropriately for installation of the air conditioner.

The objects, features and advantages of the present invention will be more apparent from the following detailed description and the accompanying drawings.

DESCRIPTION OF EMBODIMENTS

First Embodiment (Functional Configuration of Installation Check System)

Figure 1:
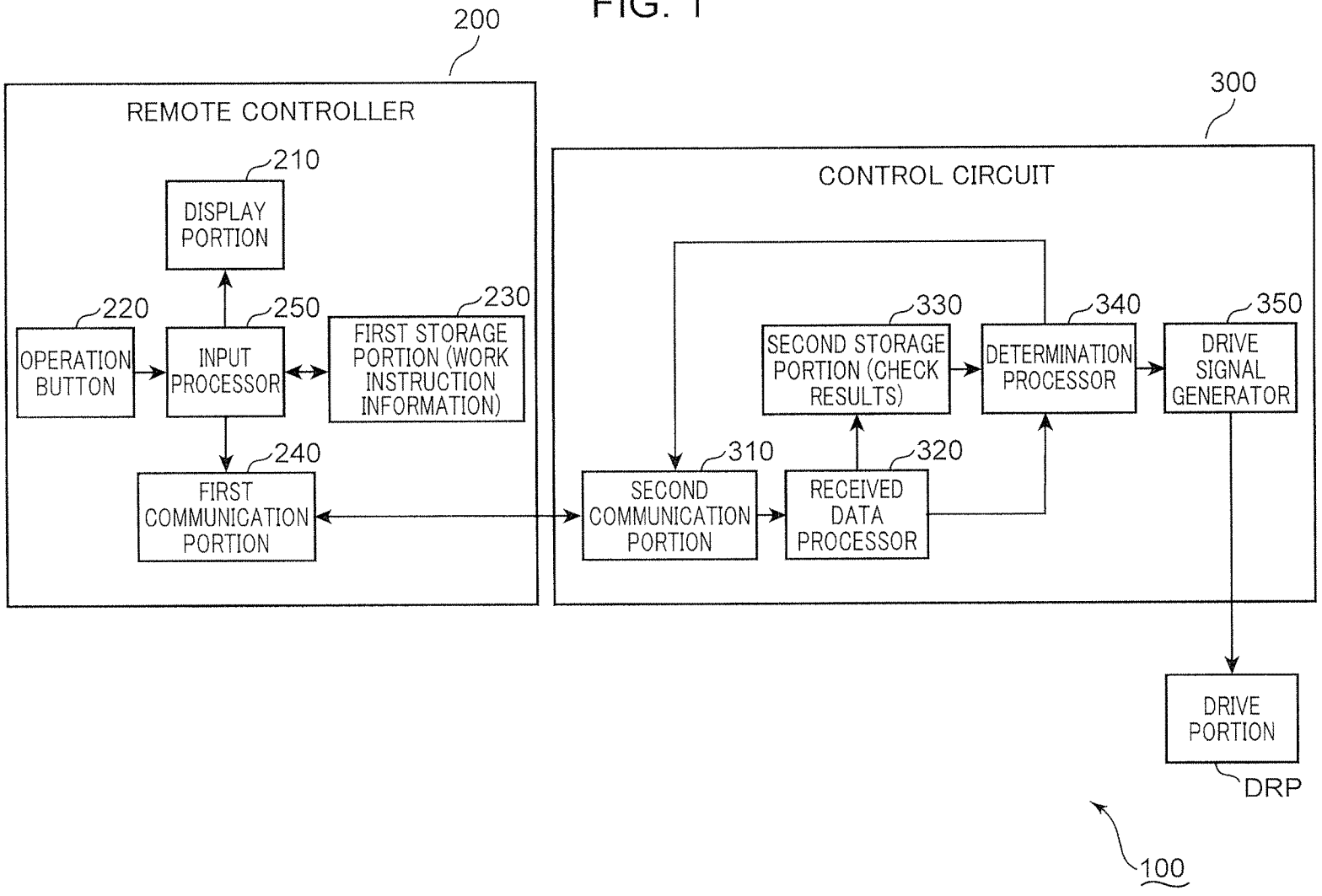
FIG. 1 is a block diagram showing a schematic functional configuration of an installation check system according to the first embodiment.

FIG. 1 is a block diagram showing a schematic functional configuration of an installation check system 100 according to the first embodiment. The installation check system 100 is described with reference to FIG. 1.

The installation check system 100 is used after execution of installation work such as installation, relocation and repair of an air conditioner. An operator refers to work instruction information presented by the installation check system 100 to confirm whether the installation work is performed in accordance with work instructions. After the operator uses the installation check system 100 to confirm that the installation work has been appropriately performed, the operator may perform a trail run of the air conditioner.

The work instruction information presented by the installation check system 100 may include various confirmation items for the installation of the air conditioner. For example, the work instruction information may include confirmation items such as whether a type of refrigerant specified for the installed air conditioner is used, whether an exterior unit of the air conditioner is situated in a sufficiently large space in case of leakage of a flammable refrigerant (e.g. R32, HFO-1234yf, HFO-1234ze, R290, R1270, or R717), and whether no upside-down brazing is performed in piping work for the flammable refrigerant. The principles of the present embodiment are not limited to specific confirmation items contained in the work instruction information.

The installation check system 100 includes a remote controller 200 and a control circuit 300. The operator operates the remote controller 200 to perform a check operation for the installation work of the air conditioner and to request a start of a trail run of the air conditioner. The control circuit 300 communicates with the remote controller 200 to determine whether the start of the trail run is allowed. Accordingly, if the control circuit 300 determines to allow the start of the trail run, the control circuit 300 generates a drive signal to drive the air conditioner. The drive signal is outputted from the control circuit 300 to a drive portion DRP (e.g. a compressor for compressing a refrigerant and a fan motor for driving a blower in the exterior unit) of the air conditioner. The control circuit 300 may be incorporated in an interior unit of the air conditioner. Alternatively, the control circuit 300 may be incorporated in the exterior unit of the air conditioner. Further alternatively, the control circuit 300 may be incorporated in a centralized controller for controlling a plurality of air conditioners. The principles of the present embodiment are not limited to a specific location of the control circuit 300.

The remote controller 200 includes a display portion 210, an operation button 220, a first storage portion 230, a first communication portion 240 and an input processor 250. The operator operates the operation button 220 to enter confirmation results about whether the installation work has been performed in accordance with the work instruction. In addition, the operator operates the operation button 220 to request a start of a trail run of the air conditioner.

The operation button 220 includes a signal generation circuit (not shown) for generating an electrical signal in response to an input operation by the operator. The electrical signal is outputted from the operation button 220 to the input processor 250. The input processor 250 controls the display portion 210 in response to the input operation by the operator.

Image data representing an image to be displayed by the display portion 210 is stored in the first storage portion 230. For example, the input processor 250 reads data representing the work instruction information from the first storage portion 230 to generate an image signal when the operator operates the operation button 220 to request displaying the work instruction information. The image signal is outputted from the input processor 250 to the display portion 210. Consequently, the display portion 210 may display the work instruction information. The display portion 210 may be a general liquid crystal display. Alternatively, the display portion 210 may be another display device configured to display an image in response to the image signal. The principles of the present embodiment are not limited to a specific display device used as the display portion 210. The first storage portion 230 may be a general storage device configured to store data. The principles of the present embodiment are not limited to a specific storage device used as the first storage portion 230.

The work instruction information may be displayed in the form of a list including confirmation items and check boxes. In this case, the operator operates the operation button 220 to put a checkmark in the checkbox after confirming that the installation work has been appropriately performed. Alternatively, the work instruction information may be displayed as an image including confirmation items and answer options. In this case, the operator operates the operation button 220 to select one of the answer options to confirm whether the installation work has been appropriately performed. The principles of the present embodiment are not limited to a specific display format of the work instruction information presented by the display portion 210. With regard to the present embodiment, the input means is exemplified by the operation button 220. The input means may be integral with the display portion 210 (e.g. a touch panel). In this case, a display area configured to receive a touch of the operator as an input may function as the input means.

Input data obtained by an input of the operator into an answer column (e.g. a check box or an answer option) may be stored in the first storage portion 230 through the input processor 250, the answer column being accompanied by the work instruction information. When the operator completes the input operation in the answer column (e.g. when the operator checks all check boxes), the input processor 250 may make the display portion 210 display a confirmation message to confirm whether the operator wants to transmit the input data. The input processor 250 then reads the input data when the operator requests the transmission of the input data in response to the confirmation message, the input data being stored in the first storage portion 230. The input data is then outputted from the input processor 250 to the first communication portion 240. The first communication portion 240 transmits the input data to the control circuit 300.

When the operator operates the operation button 220 to request a start of a trail run of the air conditioner, the input processor 250 generates a request signal which represents a request to start the trail run. The request signal is outputted from the input processor 250 to the first communication portion 240. The first communication portion 240 transmits the request signal to the control circuit 300. The input processor 250 may be a central processing unit (CPU) or other signal generation circuit to execute a program which generates a signal in response to an operation of the operation button 220. The principles of the present embodiment are not limited to a specific circuit device used as the input processor 250.

The control circuit 300 includes a second communication portion 310, a received data processor 320, a second storage portion 330, a determination processor 340 and a drive signal generator 350. The second communication portion 310 receives the input data and the request signal from the first communication portion 240. The input data and the request signal are outputted from the second communication portion 310 to the received data processor 320. General infrared communication may be used for the communication between the first and second communication portions 240, 310. In this case, general infrared communication devices are applicable to the first and second communication portions 240, 310. Alternatively, other communication techniques may be used for the communication between the first and second communication portions 240, 310. The principles of the present embodiment are not limited to specific communication techniques between the first and second communication portions 240, 310.

After the second communication portion 310 outputs the input data to the received data processor 320, the received data processor 320 writes the input data to the second storage portion 330. Consequently, a check result indicating whether the installation work has been appropriately performed is stored in the second storage portion 330. The received data processor 320 requests the determination processor 340 to perform the determination process after the second communication portion 310 outputs the request signal to the received data processor 320. The determination processor 340 performs the determination process in response to the request from the received data processor 320 to determine whether a start of a trail run of the air conditioner is allowed. The received data processor 320 may be a CPU or other signal processing circuit that executes a program to identify the received signal and determine a destination of the signal. The principles of the present embodiment are not limited to a specific circuit device used as the received data processor 320. The second storage portion 330 may be a general storage device configured to store data. The principles of the present embodiment are not limited to a specific storage device used as the second storage portion 330.

If the input data is stored in the second storage portion 330, the determination processor 340 allows a start of a trail run of the air conditioner. In this case, the determination processor 340 generates a trigger signal. The trigger signal is outputted from the determination processor 340 to the drive signal generator 350. The drive signal generator 350 generates a drive signal in response to the trigger signal. The drive signal is outputted from the drive signal generator 350 to the drive portion DRP. The drive portion DRP operates in response to the drive signal. Consequently, the trail run of the air conditioner is started. After the trail run of the air conditioner is started, the input data may be erased. In this case, old input data is prevented from being used at the time of subsequent relocation or subsequent repair of the air conditioner. Alternatively, the input data may continue to be held in the second storage portion 330. In this case, the remote controller 200 may be designed such that the operator operates the remote controller 200 to make the display portion 210 display previous data held in the second storage portion 330. The drive signal generator 350 may be a signal generation circuit provided in correspondence to each of various drive devices (e.g. a compressor for compressing a refrigerant and a fan motor for driving a blower in the exterior unit) constituting the drive portion DRP. With regard to the present embodiment, the signal generator is exemplified by the drive signal generator 350.

If the input data is not stored in the second storage portion 330, the determination processor 340 does not allow a start of a trail run of the air conditioner. In this case, the drive signal generator 350 generates no drive signal since the determination processor 340 generates no trigger signal. This prevents the operator from starting a trail run of the air conditioner without confirmation based on the work instruction information.

In addition, if a time at which the input data is written to the second storage portion 330 deviates significantly from a time at which the request signal is received, the determination processor 340 may not allow a start of a trail run of the air conditioner. Consequently, a trail run of the air conditioner is prevented from being started when there is the input data, which has been generated at installation of the air conditioner, in the second storage portion 330 whereas there is no confirmation which should be performed after subsequent relocation or repair work.

Furthermore, if there are inappropriate contents of the input data stored in the second storage portion 330, the determination processor 340 may not allow a start of a trail run of the air conditioner. For example, if the operator inputs that a corrosive material is used at a portion where anticorrosion treatment is required, the determination processor 340 generates no trigger signal. Consequently, the drive signal generator 350 generates no drive signal, so that a trail run of the air conditioner is prevented from being started under wrong installation.

If the determination processor 340 does not allow a start of a trail run of the air conditioner as a result of the determination process, the determination processor 340 generates a display request signal requesting display of an error message. The display request signal is outputted from the determination processor 340 to the second communication portion 310. The second communication portion 310 transmits the display request signal to the first communication portion 240. The input processor 250 receives the display request signal through the first communication portion 240 and causes the display portion 210 to display the error message. The installation check system 100 may encourage the operator a confirmation based on the work instruction information through the error message. The principles of the present embodiment are not limited to specific contents of the error message.

The determination processor 340 may be a CPU or other signal processing circuit that executes a program to determine whether a start of a trail run of the air conditioner is allowed on the basis of various conditions such as the presence or absence of input data stored in the second storage portion 330, a time at which the input data is written, and contents of the input data. The principles of the present embodiment are not limited to a specific circuit device used as the received data processor 320. With regard to the present embodiment, the determination portion is exemplified by the determination processor 340.

Figure 2:
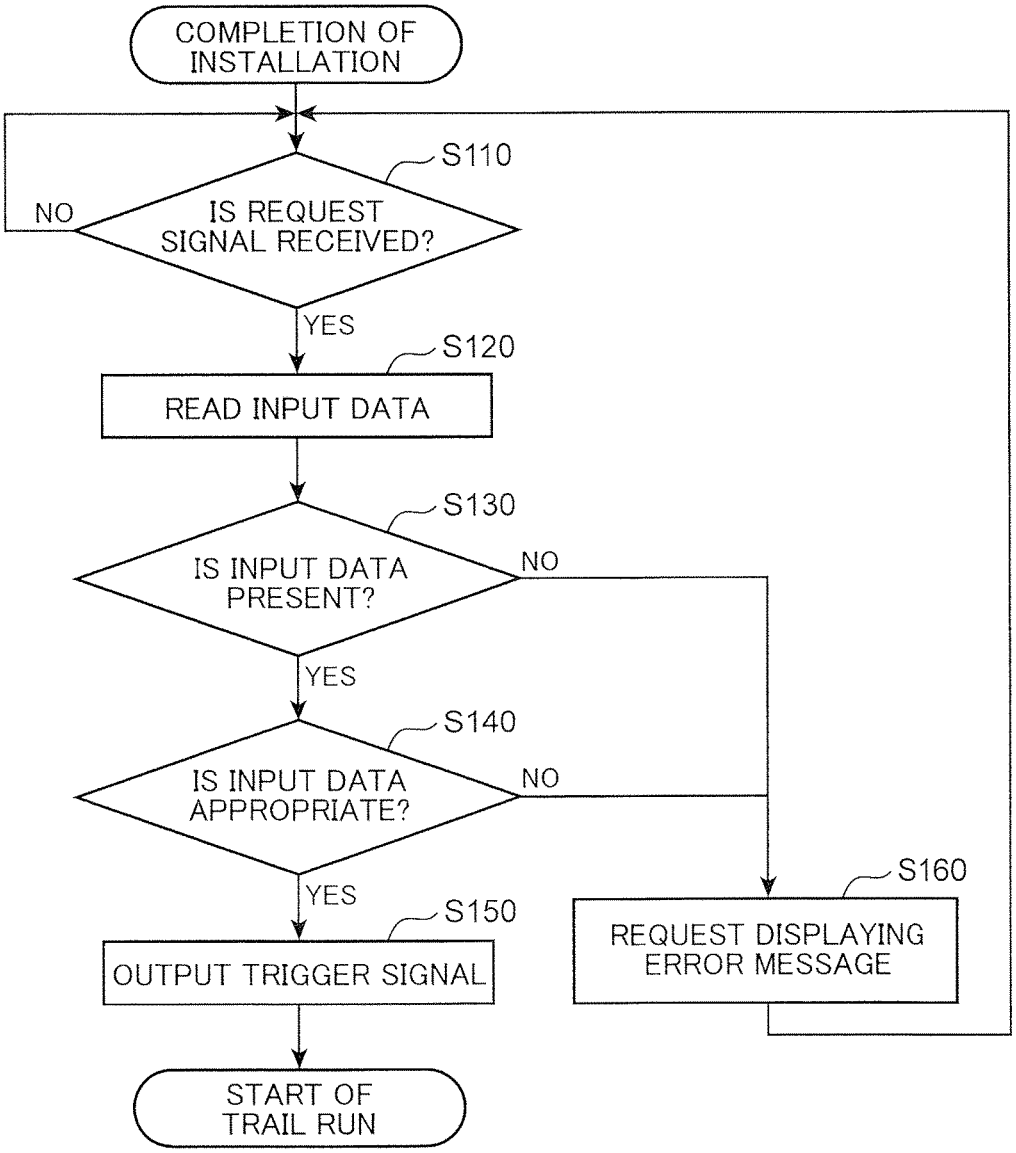
FIG. 2 is a schematic flow chart showing an exemplificative determination process performed by a determination processor of the installation check system depicted in FIG. 1.

FIG. 2 is a schematic flow chart showing an exemplificative determination process performed by the determination processor 340. The determination process is described with reference to FIGS. 1 and 2.

(Step S110)

Step S110 is performed after completion of installation of the air conditioner and before a start of a trail run of the air conditioner. Step S110 is performed until the determination processor 340 receives a request signal requesting a start of a trail run of the air conditioner. When the determination processor 340 receives the request signal, step S120 is performed.

(Step S120)

The determination processor 340 performs a process for reading input data from the second storage portion 330. Step S130 is then performed.

(Step S130)

If the input data is stored in the second storage portion 330, the determination processor 340 may read the input data from the second storage portion 330. In this case, step S140 is performed. If the input data is not stored in the second storage portion 330, the determination processor 340 fails to read the input data. In this case, step S160 is performed.

(Step S140)

The determination processor 340 determines whether the read input data is appropriate. If the determination processor 340 determines that the input data is appropriate, step S150 is performed. On the other hand, if the operator has selected an inappropriate answer option, the determination processor 340 determines that the input data is inappropriate. Or, if a time at which the input data is written deviates significantly from a time at which the request signal is received, the determination processor 340 may determine that the input data is inappropriate. In these cases, step S160 is performed. The determination processor 340 may use various other criteria to determine whether the input data is appropriate. The principles of the present embodiment are not limited to specific criteria used by the determination processor 340.

(Step S150)

The determination processor 340 generates a trigger signal. The trigger signal is outputted from the determination processor 340 to the drive signal generator 350. The drive signal generator 350 generates a drive signal in response to the trigger signal. The drive signal is outputted from the drive signal generator 350 to the drive portion DRP. The drive portion DRP operates in response to the drive signal. Consequently, a trail run of the air conditioner is started.

(Step S160)

The determination processor 340 generates a display request signal requesting display of an error message. The display request signal is then transmitted to the input processor 250 through the second and first communication portions 310, 240. The input processor 250 causes the display portion 210 to display the error message in response to the display request signal. Step S110 is then performed.

(Remote Controller)

Figure 3:
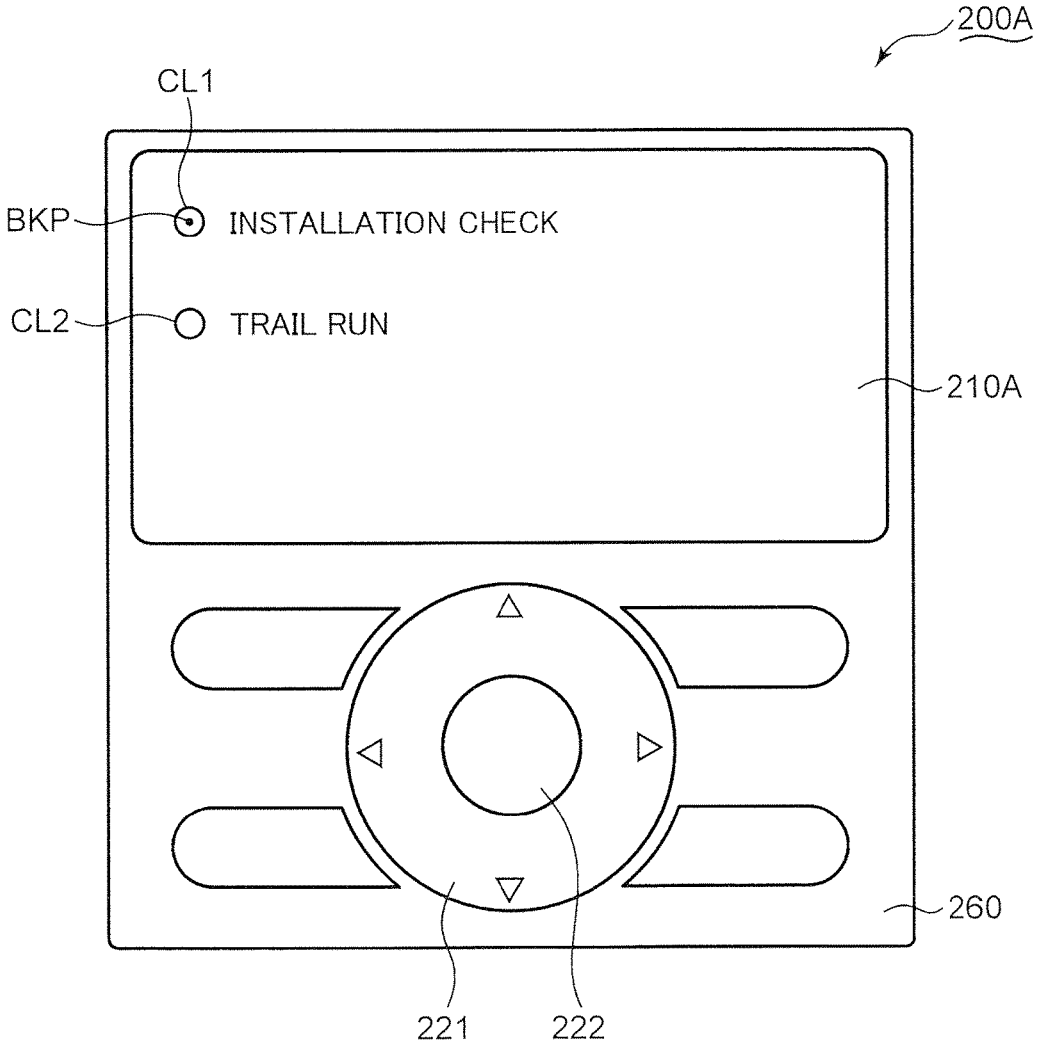
FIG. 3 is a schematic front view of an exemplificative remote controller.

FIG. 3 is a schematic front view of an exemplificative remote controller 200A. The remote controller 200A is described with reference to FIGS. 1 to 3.

The remote controller 200A may be used as the remote controller 200 described with reference to FIG. 1. In addition, the remote controller 200A may function as a device for remotely controlling an air conditioner. The remote controller 200A includes a display 210A, a selection button 221, a decision button 222 and a housing 260. The display 210A corresponds to the display portion 210 described with reference to FIG. 1. The selection button 221 and the decision button 222 correspond to the operation button 220 described with reference to FIG. 1. Various electronic components such as a CPU used as the input processor 250 and a storage device used as the first storage portion 230 are stored in the housing 260.

The selection button 221 is annular. The decision button 222 is situated substantially concentrically with the selection button 221 and is surrounded by the selection button 221. The selection button 221 is provided with arrows pointing up, down, right and left. An operator operates the selection button 221 to select a menu and an input item which are displayed on the display 210A. When the operator presses the decision button 222 after selecting a menu, a program corresponding to the selected menu is executed. When the operator presses the decision button 222 after choosing an input item, the choice of the operator is determined.

The display 210A of FIG. 3 displays menus for installation check and a trail run. The operator operates the remote controller 200A in a predetermined manner to display an image of FIG. 3 on the display 210A. The display 210A shows two circles CL1, CL2 as menu options. The circle CL1 corresponds to the menu for the installation check. The circle CL2 corresponds to the menu for the trail run. The display 210A further shows a black dot BKP representing a choice of the operator.

The operator operates the selection button 221 to display the black dot BKP in one of the circles CL1, CL2. When the operator presses the decision button 222 after displaying the black dot BKP in the circle CL1, the display 210A displays the work instruction information. When the operator presses the decision button 222 after displaying the black dot BKP in the circle CL2, the determination process described with reference to FIG. 2 is performed.

Figure 4:
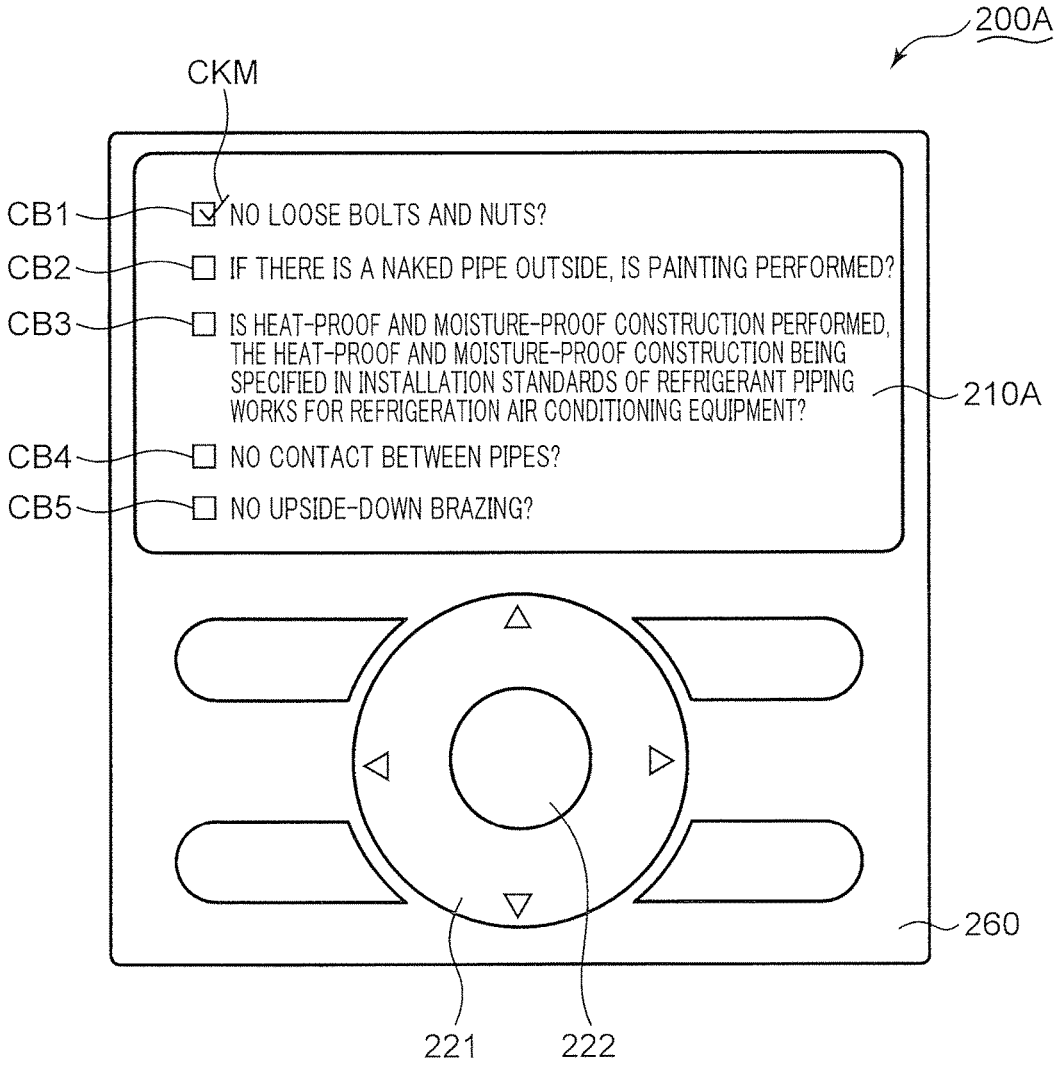
FIG. 4 is a schematic front view of the remote controller when an operator selects a menu for installation check.

FIG. 4 is a schematic front view of the remote controller 200A when the operator selects the menu for installation check described with reference to FIG. 3. The remote controller 200A is further described with reference to FIGS. 3 and 4.

The display 210A of FIG. 4 displays the work instruction information as a list. The work instruction information shown in FIG. 4 includes "confirmation for loose bolts and nuts", "confirmation for painting outdoor naked pipes", "confirmation for heat-proof and moisture-proof construction", "confirmation for contact between pipes", and "confirmation for upside-down brazing". These confirmation items are itemized. The work instruction information may include various other confirmation items. The principles of the present embodiment are not limited to specific confirmation items contained in the work instruction information.

The display 210A of FIG. 4 shows check boxes CB1, CB2, CB3, CB4, CB5 in correspondence to the respective confirmation items. The check box CB1 is displayed in correspondence to "confirmation for loose bolts and nuts". The check box CB2 is displayed in correspondence to "confirmation for painting outdoor naked pipes". The check box CB3 is displayed in correspondence to "confirmation for heat-proof and moisture-proof construction". The check box CB4 is displayed in correspondence to "confirmation for contact between pipes". The check box CB5 is displayed in correspondence to "confirmation for upside-down brazing".

The operator operates the selection button 221 to select a check box as an input target. The selected check box may be displayed in a different color from other check boxes. The operator presses the decision button 222 after selecting the target check box. Consequently, a check mark CKM is put in the check box of the input target.

Figure 5:
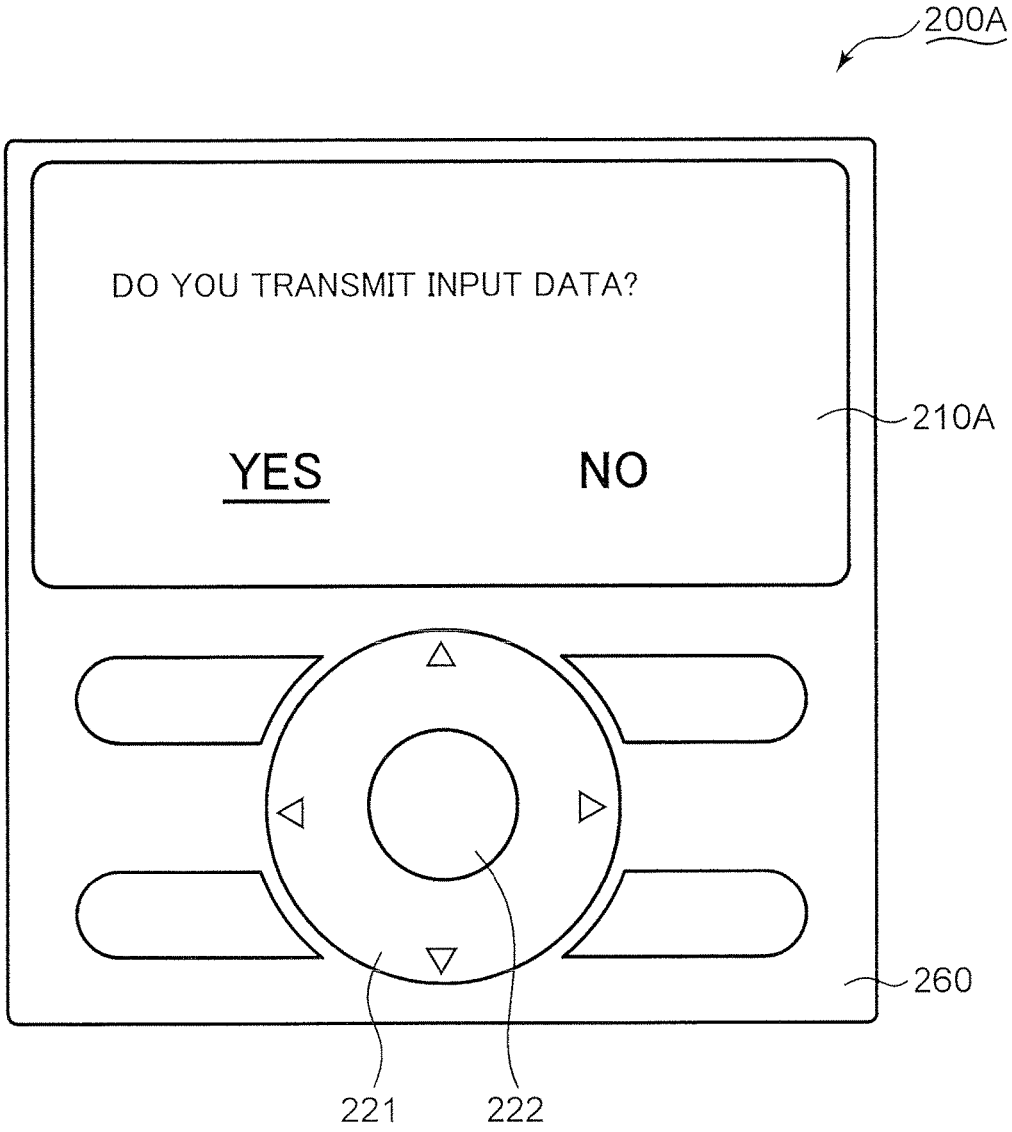
FIG. 5 is a schematic front view of the remote controller after an input operation.

FIG. 5 is a schematic front view of the remote controller 200A after the input operation, which is described with reference to FIG. 4. The remote controller 200A is further described with reference to FIGS. 2 to 5.

When the operator puts check marks CKMs in all the check boxes, the display 210A displays a message, and "Yes" and "No" options for the operator, the message inquiring whether the operator wants to transmit the input data. The display 210A of FIG. 5 uses an underline attached to "Yes" or "No" option to represent an operator's choice. The operator operates the selection button 221 to select one of "Yes" and "No" options. When the operator selects "Yes" option and presses the decision button 222, the input data is stored in the second storage portion 330 described with reference to FIG. 1. When the operator selects "No" option and presses the decision button 222, the operator may perform the input operation described with reference to FIG. 4 again.

After the operator transmits the input data, the display 210A may display the menu selection screen described with reference to FIG. 3. The determination process described with reference to FIG. 2 is then performed when the operator puts the black dot BKP in the circle CL2 and presses the decision button 222. The display 210A for displaying the work instruction information, the selection button 221 and the decision button 222, which are operated to input check results on the basis of the work instruction information and to start a trail run of the air conditioner, are incorporated into the remote controller 200A, so that the operator may easily confirm the installation and perform a trail run of the air conditioner. With regard to the present embodiment, the operation device is exemplified by the remote controller 200A.

Figure 6:
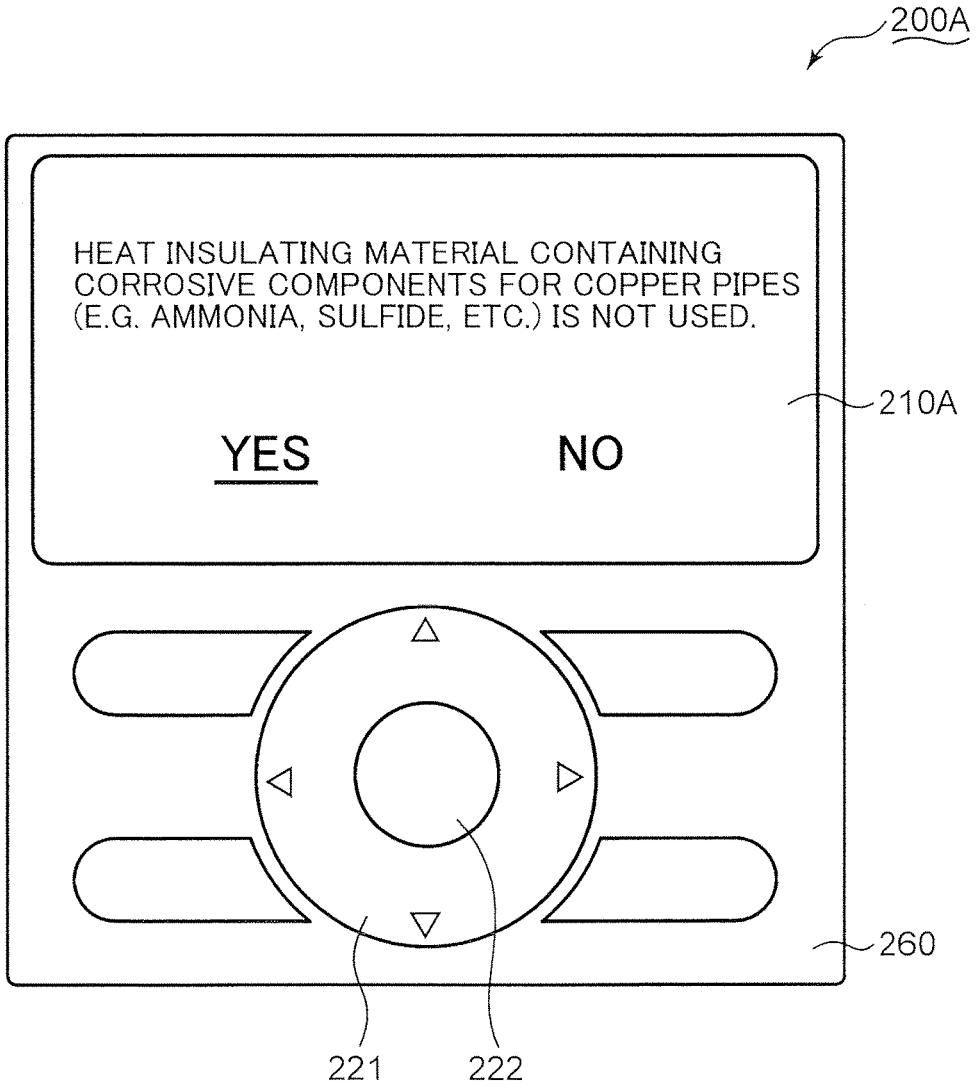
FIG. 6 is a schematic front view of the remote controller when the operator selects a menu for the installation check.

FIG. 6 is a schematic front view of the remote controller 200A when the operator selects the menu for the installation check described with reference to FIG. 3. Other display formats for the work instruction information are described with reference to FIGS. 1, 3 to 6.

The display 210A of FIG. 6 displays "confirmation for a type of heat insulating material" and "Yes" and "No" options. When the operator selects one of "Yes" and "No" options and presses the decision button 222, the display 210A sequentially displays confirmation items (e.g. various confirmation items described with reference to FIG. 4) prepared after "confirmation for a type of heat insulating material". When the operator replies to all of the prepared confirmation items, the display 210A displays the image of FIG. 5. When the operator selects "Yes" option shown in FIG. 5 and presses the decision button 222, the input data is stored in the second storage portion 330 described with reference to FIG. 1. When the operator selects "No" option shown in FIG. 5 and presses the decision button 222, the operator may perform the input operation described with reference to FIG. 6 again.

After the operator transmits the input data, the display 210A may display the menu selection screen described with reference to FIG. 3. The determination process described with reference to FIG. 2 is then performed when the operator puts the black dot BKP in the circle CL2 and presses the decision button 222. The determination processor 340 described with reference to FIG. 1 determines whether the operator's answer is appropriate in step S140 described with reference to FIG. 2. For example, if the operator selects "Yes" option for "confirmation for a type of heat insulating material" shown in FIG. 6, the determination processor 340 determines that the operator's answer is appropriate. On the other hand, if the operator selects "No" option for "confirmation for a type of heat insulating material", the determination processor 340 determines that the operator's answer is inappropriate. In this case, the display 210A may display an error message requesting to check the construction again for "confirmation for a type of heat insulating material".

Second Embodiment

An installation check system may be designed as a single operation unit incorporated in a controller of an exterior unit of an air conditioner, a controller of an interior unit of the air conditioner, or a centralized controller for controlling a plurality of air conditioners. In this case, an operator operates an operation panel mounted on the interior unit of the air conditioner or the centralized controller for controlling the air conditioners to confirm whether the installation has been appropriately performed, similarly to the first embodiment. An installation check system is described in the second embodiment, the installation check system being designed as a single operation unit.

Figure 7:
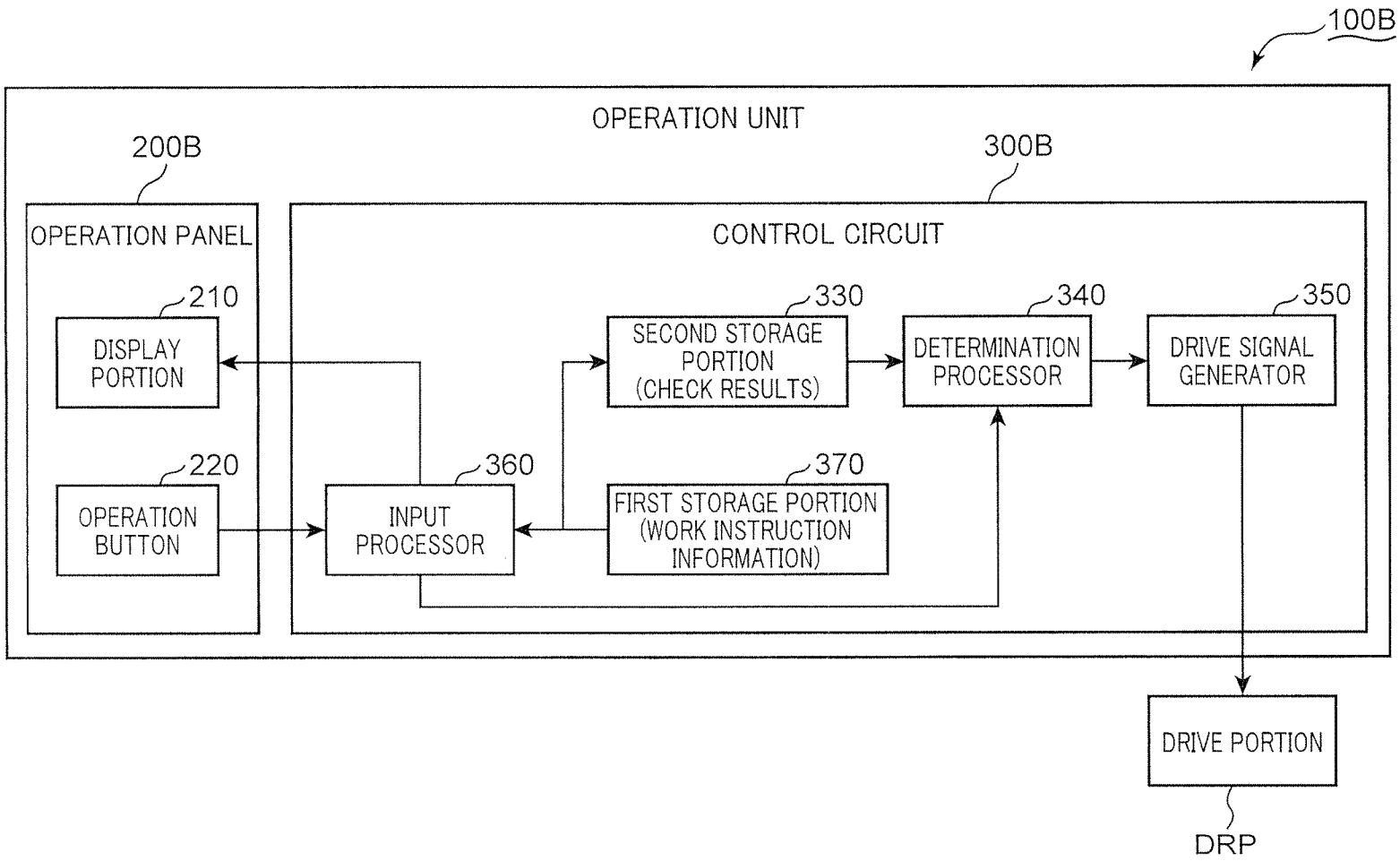
FIG. 7 is a block diagram showing a schematic functional configuration of an installation check system according to the second embodiment.

FIG. 7 is a block diagram showing a schematic functional configuration of an installation check system 100B according to the second embodiment. The installation check system 100B is described with reference to FIGS. 1 to 4, 6 and 7. Components having the same functions as those of the first embodiment are denoted by the same reference numerals. The description of the first embodiment is applicable to the components having the same reference numerals.

The installation check system 100B is designed as a single operation unit mounted on a controller of an exterior unit of an air conditioner, a controller of an interior unit of the air conditioner, or a centralized controller for controlling a plurality of air conditioners. The installation check system 100B includes an operation panel 200B and a control circuit 300B. The operation panel 200B is fixed to an outer surface of a device incorporating the installation check system 100B. An operator operates the operation panel 200B to input check results based on the work instruction information and to request a start of a trail run of the air conditioner. The control circuit 300B is situated in the device incorporating the installation check system 100B. The control circuit 300B is electrically connected to the operation panel 200B. The control circuit 300B performs signal processes in response to an input operation by the operator on the operation panel 200B.

Like the remote controller 200 described in the context of the first embodiment, the operation panel 200B includes the display portion 210 and the operation button 220. The description of the first embodiment is applicable to these components. With regard to the present embodiment, the operation device is exemplified by the operation panel 200B.

Like the control circuit 300 described in the context of the first embodiment, the control circuit 300B includes the second storage portion 330, the determination processor 340 and the drive signal generator 350. The description of the first embodiment is applicable to these components.

The control circuit 300B further includes an input processor 360 and a first storage portion 370. The operation button 220 includes a signal generation circuit (not shown) for generating an electrical signal in response to an input operation by the operator. The electrical signal is outputted from the operation button 220 to the input processor 360. The input processor 360 controls the display portion 210 in response to the input operation by the operator.

Like the first storage portion 230 of the remote controller 200 described in the context of the first embodiment, the first storage portion 370 stores image data representing an image to be displayed by the display portion 210 (e.g. the image to be displayed by the display portion 210A described with reference to FIGS. 3, 4 and 6). The input processor 360 reads data representing the work instruction information from the first storage portion 370 to generate an image signal when the operator operates the operation button 220 to request displaying the work instruction information. The image signal is outputted from the input processor 360 to the display portion 210. Consequently, the display portion 210 may display the work instruction information. The first storage portion 370 may be a general storage device configured to store data. A single storage device may function as the first and second storage portions 370, 330. The principles of the present embodiment are not limited to a specific storage device used as the first storage portion 230.

When the operator refers to the work instruction information displayed on the display portion 210 and enters a check result in each confirmation item, the input processor 360 generates input data representing the check result. The input data is outputted from the input processor 360 to the determination processor 340. The determination processor 340 performs processes which are similar to the determination process described with reference to FIG. 2 to determine whether a start of a trail run of the air conditioner is allowed.

If the input data is stored in the second storage portion 330, the determination processor 340 allows a start of a trail run of the air conditioner. In this case, the determination processor 340 generates a trigger signal. The trigger signal is outputted from the determination processor 340 to the drive signal generator 350. The drive signal generator 350 generates a drive signal in response to the trigger signal. The drive signal is outputted from the drive signal generator 350 to the drive portion DRP. The drive portion DRP operates in response to the drive signal. Consequently, the trail run of the air conditioner is started. When the input data is not stored in the second storage portion 330 or when appropriate input data is not stored in the second storage portion 330, the determination processor 340 does not allow a start of a trail run of the air conditioner. In this case, the determination processor 340 generates no trigger signal, so that the drive signal generator 350 generates no drive signal. This prevents the operator from starting a trail run of the air conditioner without appropriate confirmation based on the work instruction information.

The exemplificative techniques described in the context of the aforementioned various embodiments mainly include the following features.

An installation check system according to one aspect of the present invention is used for checking installation of an air conditioner before a start of a trail run of the air conditioner. The installation check system includes a display portion configured to display work instruction information about the installation, an input means configured to be operated for entering a check result based on the work instruction information, a determination portion configured to determine whether the start of the trail run is allowed based on the check result, and a signal generator which generates a drive signal to perform the trail run. The signal generator generates the drive signal under condition of the determination portion allowing the start of the trail run.

According to the aforementioned configuration, since the signal generator generates a drive signal to perform a trail run under condition of the determination portion allowing the start of the trail run, the trail run of the air conditioner is not started unless an operator performs a check operation based on the work instruction information. Since the operator has to perform the check operation on the basis of the work instruction information in order to execute the trail run of the air conditioner, the installation check system makes the operator perform the check operation for the installation of the air conditioner. Since the installation check system allows the trail run of the air conditioner after the operator executes the check operation, the trail run of the air conditioner is executed with appropriate installation.

With regard to the aforementioned configuration, the display portion may display the work instruction information as a list.

According to the aforementioned configuration, since the display portion displays the work instruction information as a list, the operator may easily perform the check operation on the basis of the work instruction information. The "list" includes not only a simple itemized list but also an itemized list which may be checked by touching a touch panel or operating a button of a controller such as a remote controller.

With regard to the aforementioned configuration, the list may represent a confirmation item for handling a flammable refrigerant flowing in the air conditioner.

According to the aforementioned configuration, since the list represents a confirmation item for handling a flammable refrigerant flowing in the air conditioner, the trail run of the air conditioner is executed after appropriate installation is performed in terms of handling the flammable refrigerant.

With regard to the aforementioned configuration, the input means may be operated to start the trail run. The input means and the display portion may be incorporated in a single operation device.

According to the aforementioned configuration, since the input means and the display portion are incorporated in a single operation device, the operator may easily execute the check operation on the basis of the work instruction information. The "single operation device" refers to, for example, a remote controller, touch panel or centralized controller.

INDUSTRIAL APPLICABILITY

The principles of the aforementioned embodiments are suitable for use in installation of air conditioners.

The invention claimed is:

1. An installation check system used for checking installation of an air conditioner before a start of a trial run of the air conditioner, the installation check system comprising:

a display configured to display work instruction information including answer options about the installation, an operation button or a display area of a touch panel configured to be operated for entering an option selected from the answer options, a determination processor configured to determine whether the start of the trial run is allowed based on the selected option, and a signal generation circuit which generates a drive signal to execute the trial run, wherein the signal generation circuit generates the drive signal under condition of the determination processor allowing the start of the trial run, wherein the determination processor determines whether the selected option is a predetermined one of the answer options, and allows the start of the trial run if the selected option is the predetermined one of the answer options.

2. The installation check system according to claim 1, wherein the display displays the work instruction information as a list.

3. The installation check system according to claim 2, wherein the list represents a confirmation item for handling a flammable refrigerant flowing in the air conditioner.

4. The installation check system according to claim 1, wherein the operation button is operated to start the trial run; and wherein the operation button and the display are incorporated in a single operation device.

5. The installation check system according to claim 1, when the selected option is transmitted to the determination processor, the display displays a message to confirm whether to allow transmission of the selected option or not.

6. An installation check system used for checking installation of an air conditioner before a start of a trial run of the air conditioner, the installation check system comprising:

a display configured to display work instruction information about the installation, an operation button or a display area of a touch panel configured to be operated for entering a check result based on the work instruction information, a storage configured to store the check result written through the operation button or the display area of the touch panel, a determination processor configured to determine whether the start of the trial run is allowed based on the check result, and a signal generation circuit which generates a drive signal to execute the trial run, wherein the signal generation trial generates the drive signal under condition of the determination processor allowing the start of the trial run, wherein the determination processor determines whether a period between a written time of the check result into the storage and a time at which the determination processor performs a determination process exceeds a threshold, and allows the start of the trial run unless the period exceeds the threshold.

7. The installation check system according to claim 6, wherein the display displays the check result stored in the storage.

* * * * *